US011607767B2

(12) United States Patent
Wu et al.

(10) Patent No.: US 11,607,767 B2
(45) Date of Patent: Mar. 21, 2023

(54) ADJUSTABLE WHEEL DEBURRING DEVICE

(71) Applicant: CITIC Dicastal Co., LTD, Qinhuangdao (CN)

(72) Inventors: Guorui Wu, Qinhuangdao (CN); Bowen Xue, Qinhuangdao (CN); Jiandong Guo, Qinhuangdao (CN)

(73) Assignee: CITIC Dicastal Co., LTD, Qinhuangdao (CN)

( * ) Notice: Subject to any disclaimer, the term of this patent is extended or adjusted under 35 U.S.C. 154(b) by 880 days.

(21) Appl. No.: 16/548,839

(22) Filed: Aug. 23, 2019

(65) Prior Publication Data

US 2020/0139502 A1 May 7, 2020

(30) Foreign Application Priority Data

Nov. 6, 2018 (CN) ..... 201811312747.5

(51) Int. Cl.
*B24B 41/06* (2012.01)
*B24B 5/44* (2006.01)

(52) U.S. Cl.
CPC ..... *B24B 5/44* (2013.01); *B24B 41/06* (2013.01)

(58) Field of Classification Search
CPC ..... B24B 29/005; B24B 5/44; B24B 27/0076; B24B 41/067; B24B 21/008; B24B 9/005; B24B 9/002; B24B 9/04; B24B 21/006; B24D 13/145; B24D 13/10; B08B 1/002; B05B 13/0235; B05B 13/0285; B21D 53/30
USPC ..... 451/283, 59
See application file for complete search history.

(56) References Cited

U.S. PATENT DOCUMENTS

| | | | | |
|---|---|---|---|---|
| 9,782,866 | B1 * | 10/2017 | Xue | B24B 27/0069 |
| 10,160,051 | B2 * | 12/2018 | Xue | B23D 79/04 |
| 2016/0184958 | A1 * | 6/2016 | Xue | B24B 29/005 451/283 |
| 2017/0209976 | A1 * | 7/2017 | Xue | B24B 5/44 |
| 2018/0085882 | A1 * | 3/2018 | Xue | B24B 9/00 |

* cited by examiner

*Primary Examiner* — Joseph J Hail
*Assistant Examiner* — Arman Milanian
(74) *Attorney, Agent, or Firm* — Yong Chen

(57) ABSTRACT

The present application relates to an adjustable wheel deburring device, comprising a lower lifting-translating-overturning system, a clamping driving system, a upper lifting-moving system, a adjusting system, a brush unit and a upper deburring system, among others. The device according to the present invention in use is able to not only remove burrs at the back cavity and front of the wheel, but also automatically adjust the shape of the brush belt according to the shape of the wheel back cavity.

1 Claim, 4 Drawing Sheets

ADJUSTABLE WHEEL DEBURRING DEVICE

CROSS-REFERENCE TO RELATED APPLICATIONS

The present application claims the priority of Chinese patent application No. 201811312747.5, filed on Nov. 6, 2018, which is hereby incorporated by reference in its entirety.

TECHNICAL FIELD

The present invention relates to a deburring device, and more particularly to an adjustable wheel deburring device.

BACKGROUND

In the machining process of aluminum alloy wheels, due to the reasons of process, tool, lubrication and the like, burrs are inevitably generated in the back cavity and front of the wheel. If these burrs are not removed in time, the subsequent coating effect will be seriously affected; since the general wheel manufacturers produce in mixed-line, that is, the wheels of different sizes and different wheel widths will flow at the same time in the production line. Therefore, there is a need for an automated deburring device that can adjust the shape of the brush depending on the shape of the different back cavity.

SUMMARY

It is an object of the present invention to provide an adjustable wheel deburring device which in use is enable to not only remove burrs at the back cavity and front of the wheel, but also automatically adjust the shape of the brush belt according to the shape of the wheel back cavity.

In order to achieve the above object, the technical solution of the present invention is as follows: adjustable wheel deburring device comprises a frame, lower guiding posts, lower guiding sleeves, a lower fixing plate, a lower lifting plate, a lower guiding rail I, a lower sliding plate, a lower guiding rail II, a lower sliding block, a lower servo motor I, a lower fixing frame, a lower bearing pedestal I, a lower shaft I, a rotating frame, an upper cylinder I, an upper fixing plate, upper racks, an upper rail I, a left sliding plate, left bearing pedestals, left shafts, V-type rollers, an upper plate, an upper sliding plate, an upper guiding rail II, an upper lifting plate, upper guiding posts, upper guiding sleeves, upper cylinders II, an upper servo electric cylinder, an upper gear, right shafts, right bearing pedestals, a right sliding plate, an upper servo motor I, an overturning rod, a lower servo electric cylinder I, a lower servo electric cylinder II, a lower cylinder I, a tension pulley, a fixing block I, a lower servo electric cylinder III, a lower servo motor II, a lower servo motor III, a lower gear, an angle frame, lower racks, a lower guiding rail III, a left fixing frame, a sliding sleeve I, a connecting rod I, a supporting wheel I, a spring, brush bundles, a brush belt, a sliding sleeve II, a connecting rod II, a supporting wheel II, a sliding sleeve III, a connecting rod III, a supporting wheel III, a top plate, a lower vertical plate, a lower servo electric cylinder IV, a right adjusting wheel, a right bracket, a ring-pull, a lower bottom plate, a lower servo electric cylinder V, a left adjusting wheel, a rotating shaft I, a pulley I, a synchronous belt, a pulley II, a lower servo motor IV, a shaft II, a left plate, an upper shaft I, an upper bearing pedestal I, an upper servo motor I, an upper plate, a bevel gear I, an upper bearing pedestal II, round brushes, an upper shaft II, a right plate, a bevel gear II and an upper servo motor II.

The lower lifting-translating-overturning system comprises: the four lower guiding sleeves are fixed on the lower fixing plate; the four lower guiding posts matching with the four lower guiding sleeves are fixed below the lower lifting plate; the two lower cylinders I are fixed below the lower fixing plate, and the output end thereof is hinged to the lower part of the lower lifting plate; the lower sliding plate is mounted above the lower lifting plate through the lower rail I; the lower servo electric cylinder II is fixed on the right side above the lower lifting plate, and the output end thereof is connected with the lower sliding plate; the lower slider is mounted above the lower sliding plate through the lower rail II; the lower servo electric cylinder I is fixed on the right side above the lower sliding plate, and the output end thereof is connected with the lower slider; the lower part of the lower fixing frame is hinged to the lower slider; the upper end of the overturning rod is hinged to the right side of the lower fixing frame; the lower end of the overturning rod is hinged to the right side above the lower slider; the lower bearing pedestal I is fixed above the top plate of the lower fixing frame; the lower shaft I is mounted inside the lower bearing pedestal I through a bearing; the lower servo motor I is fixed below the top plate of the lower fixing frame, and the output end thereof is connected to the lower end of the lower shaft I; and the rotating frame is fixed on the top end of the lower shaft I.

The clamping driving system comprises: the left sliding plate and the right sliding plate are respectively mounted above the upper fixing plate through the upper rail I; the two left bearing pedestals are fixed above the left sliding plate; the two left shafts are respectively mounted inside the two left bearing pedestals through bearings; the two right bearing pedestals are fixed above the right sliding plate; the two right shafts are respectively mounted inside the two right bearing pedestals through bearings; the top ends of the two left shafts and the two right shafts are respectively fixed with V-type rollers; the upper cylinder I is fixed above the upper fixing plate, and the output end thereof is connected with the left shaft; the upper gear is fixed on the middle position above the upper fixing plate; the lower parts of the left sliding plate and the right sliding plate are respectively fixed with upper racks; the upper rack is meshed with the upper gear; and the upper servo motor I is fixed below the right sliding plate, and the output end thereof is connected with one of the right shafts.

The upper lifting-moving system comprises: the four upper guiding sleeves are fixed above the top plate of the frame; the four upper guiding posts matching with the four upper guiding sleeves are fixed above the upper lifting plate; the two upper cylinders II are also fixed on the top end of the frame, and the output ends thereof are hinged to the upper part of the upper lifting plate; the upper sliding plate is mounted below the upper lifting plate through the upper rail II; the upper vertical plate is fixed below the upper sliding plate; and the upper servo electric cylinder is fixed on the right side below the lower lifting plate, and the output end thereof is connected to the right side of the upper sliding plate.

The adjusting system comprises: the lower servo electric cylinder III is fixed below the angle frame, and the output end thereof is fixed with the fixing block I; the tensioning wheel is mounted below the fixing block I through a pin shaft; the lower servo motor II is fixed on the left side of the rotating frame, and the output end thereof is connected to the angle frame through the rotating shaft II; the left fixing frame and the right bracket are respectively mounted on the top end of the angle frame through the lower rail III; the left side of the left fixing frame and the right side of the right bracket are respectively fixed with lower racks; the lower servo motor III is fixed below the top end of the angle frame, and the output end thereof is fixed with the lower gear; the lower gear is meshed with the lower racks; the top plate is fixed on the top of the angle frame; the vertical plate is fixed below the top plate; the lower bottom plate is fixed below the lower vertical plate; the sliding sleeve I, the sliding sleeve II and the sliding sleeve III are respectively hinged to the top plate, the sliding sleeve II is placed in the middle position, and the sliding sleeve I is placed on the left side of the sliding sleeve II; the connecting rod I is slidably matched with the inner hole of the sliding sleeve I; the supporting wheel I is mounted on the top end of the connecting rod I; the connecting rod II is slidably engaged with the inner hole of the sliding sleeve II; the supporting wheel II is mounted on top end of the connecting rod II; the connecting rod III is slidably matched with the inner hole of the sliding sleeve III; the supporting wheel III is mounted on the top end of the connecting rod III; the lower parts of the connecting rod I, the connecting rod II and the connecting rod III are hinged with the ring-pull; the cylinder body of the lower servo electric cylinder IV is hinged with the lower vertical plate; the output end of the lower servo electric cylinder IV is hinged with the ring-pull; the cylinder body of the lower servo electric cylinder V is hinged with the lower bottom plate; the output end of the lower servo electric cylinder V is hinged with the ring-pull; the right adjusting wheel is mounted on the top end of the right bracket; the left adjusting wheel is mounted on the top end of the left fixing frame through the rotating shaft I; the pulley I is fixed on the right side of the rotating shaft I; the lower servo motor IV is fixed on the right side of the fixing frame, and the output end thereof is fixed with the pulley II; the pulley I and the pulley II are connected by the synchronous belt; the spring is mounted below the brush bundles; the brush belt is mounted with a plurality of brush bundle which are closely arranged; and the inner side of the brush belt is simultaneously meshed with the left adjusting wheel, the supporting wheel I, the supporting wheel II, the supporting wheel III, the right adjusting wheel, and the tension pulley.

The brush unit comprises: the upper bearing pedestal II is fixed above the upper plate; the upper shaft II is mounted inside the upper bearing pedestal II through a bearing; the round brushes are fixed above the upper shaft II; and the bevel gear I is fixed below the upper shaft II. The present device comprises a plurality of sets of brush units uniformly distributed in the circumferential direction.

The upper deburring system comprises: the upper bearing pedestal I is fixed on the right side of the upper plate; the upper shaft I is mounted inside the upper bearing pedestal I through a bearing; the right end of the upper shaft I is connected with the left plate; the upper servo motor I is fixed on the left side of the upper plate, and the output end thereof is connected to the left side of the upper shaft I; the upper plate is fixed on the top end of the left plate; the right plate is fixed below the upper plate and placed on the right side of the left plate; the upper servo motor II is fixed on the right side of the right plate, and the output end thereof is fixed with the bevel gear II; and the bevel gear II is simultaneously meshed with the bevel gear I of each brush unit.

During operation, the upper cylinder I causes the four V-type rollers to synchronously clamp the wheel through the upper rail I, the upper gear and the upper racks; the upper servo motor I rotates the clamped wheel through the right shaft; the lower servo motor IV drives the left adjusting wheel to rotate through the pulley I, the pulley II and the synchronous belt; the left adjusting wheel can drive the brush belt to rotate; the lower servo motor III can adjust the space between the left adjusting wheel and the right adjusting wheel through the lower gear, the lower racks and the lower guiding rail III, to adapt to different sizes of wheels; at the same time, the lower servo electric cylinder III moves the tensioning wheel up and down to adapt to the belt length of the brush belt after the adjustment of the space between the left adjusting wheel and the right adjusting wheel; by the lower servo electric cylinder V pulling the connecting rod I, the connecting rod II and the connecting rod III to move up and down, the height of the brush belt between the left adjusting wheel and the right adjusting wheel can be adjusted; and by the lower servo electric cylinder IV pulling the connecting rod I, the connecting rod II and the connecting rod III to move left and right, the shape of the brush belt between the left adjusting wheel and the right adjusting wheel can be adjusted to adapt to various wheel back chambers of different shapes.

The lower servo motor II can adjust the angle of the brush belt in the vertical direction through the rotating shaft II; the lower servo motor I can rotate the rotating frame and the brush belt in the vertical direction through the lower shaft I; the lower servo electric cylinder I can adjust the angles of the rotating frame and the brush belt in horizontal direction through the lower rail II and the overturning rod; the lower servo electric cylinder II can adjust the position of the rotating frame and the brush belt in the horizontal direction through the lower rail I; and the lower cylinder I can cause the rotating brush belt to be lifted through the lower guiding posts and the lower guiding sleeves, and the burrs therein can be removed when the brush belt comes into contact with the wheel back cavity.

The upper servo motor II drives the bevel gear II to rotate, thereby driving each of the bevel gear I, the upper shaft II and the round brushes to simultaneously rotate through the meshing of the bevel gear II and the bevel gear I; the upper servo motor I can drive the left plate and each of the round brushes to rotate in the vertical direction through the upper shaft I; the upper servo electric cylinder can adjust the position of the round brush in the horizontal direction through the upper rail II and the upper sliding plate; and the upper cylinder II can lower the round brushes through the upper guiding posts and the upper guiding sleeves, and the front burrs are removed when the rotating round brushes contact the front of the wheel.

The present invention in use is able to not only remove burrs at the back cavity and front of the wheel, but also automatically adjust the shape of the brush belt according to the shape of the wheel back cavity.

DETAILED DESCRIPTION

Figure 1:
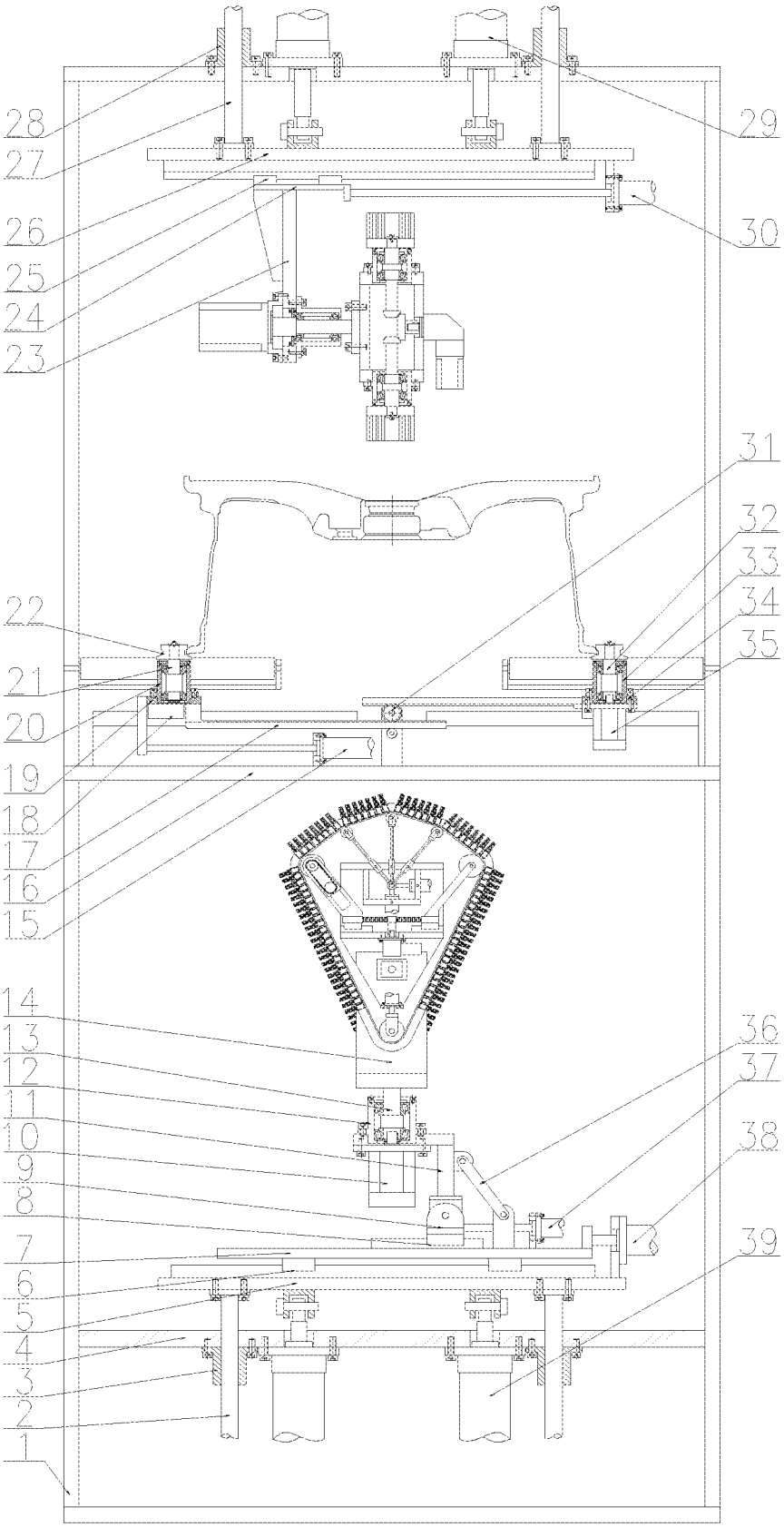
FIG. 1 is the main view of the adjustable wheel deburring device of the present invention.
Figure 2:
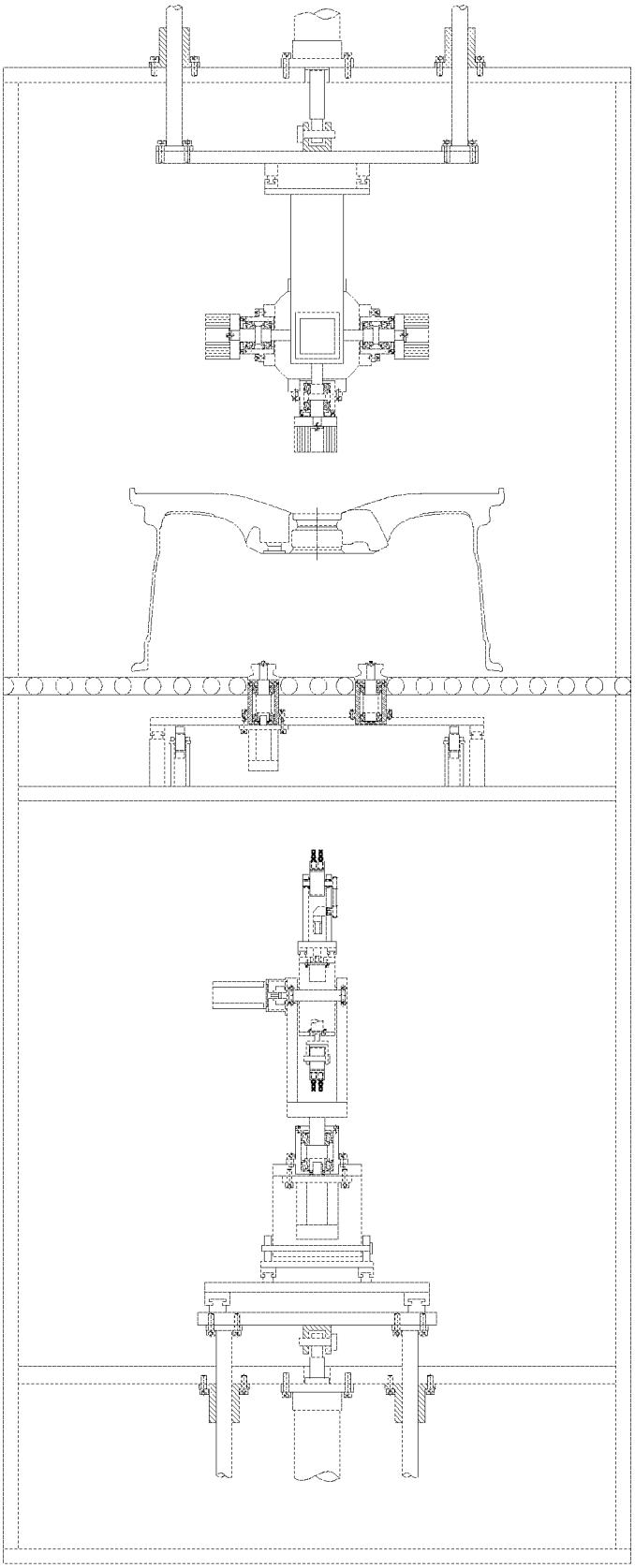
FIG. 2 is the left view of adjustable wheel deburring device.
Figure 3:
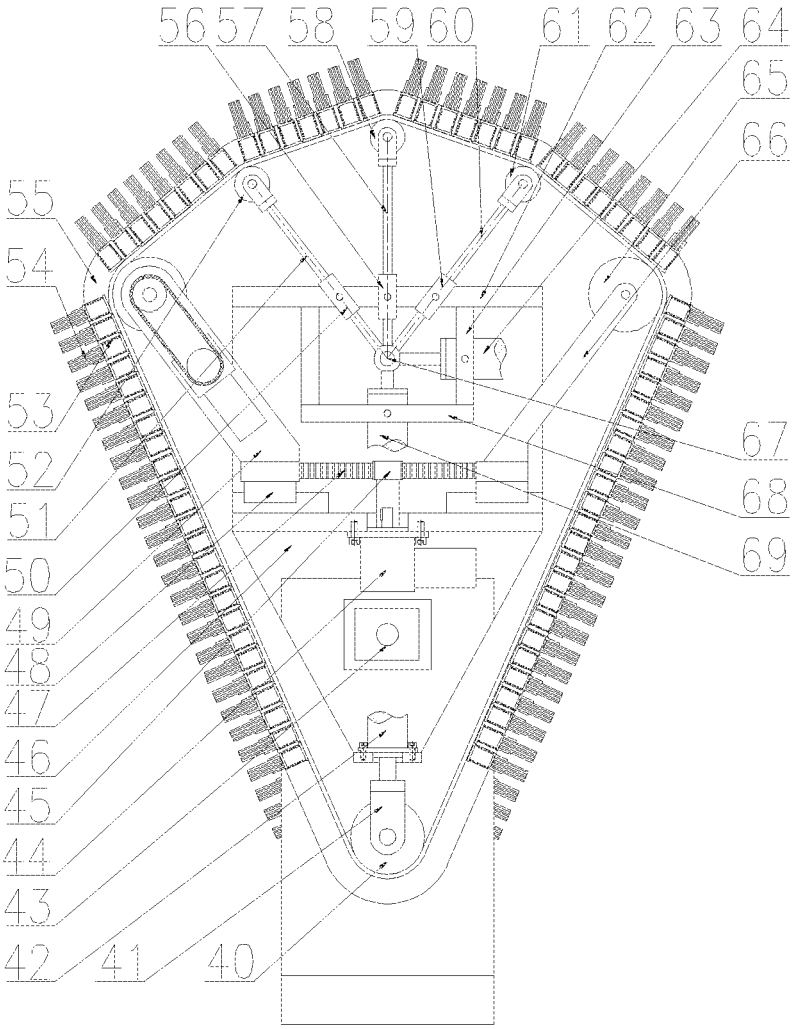
FIG. 3 is the main view of the adjusting system of adjustable wheel deburring device.
Figure 4:
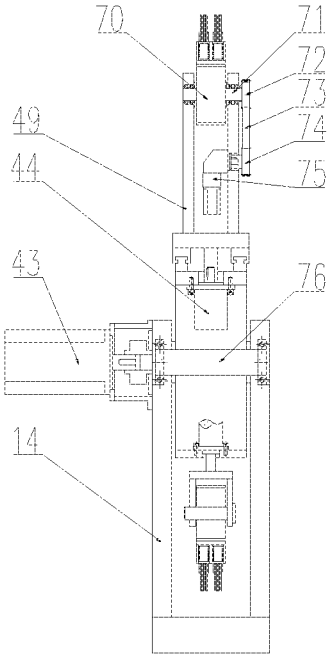
FIG. 4 is the left view of the adjusting system of adjustable wheel deburring device.
Figure 5:
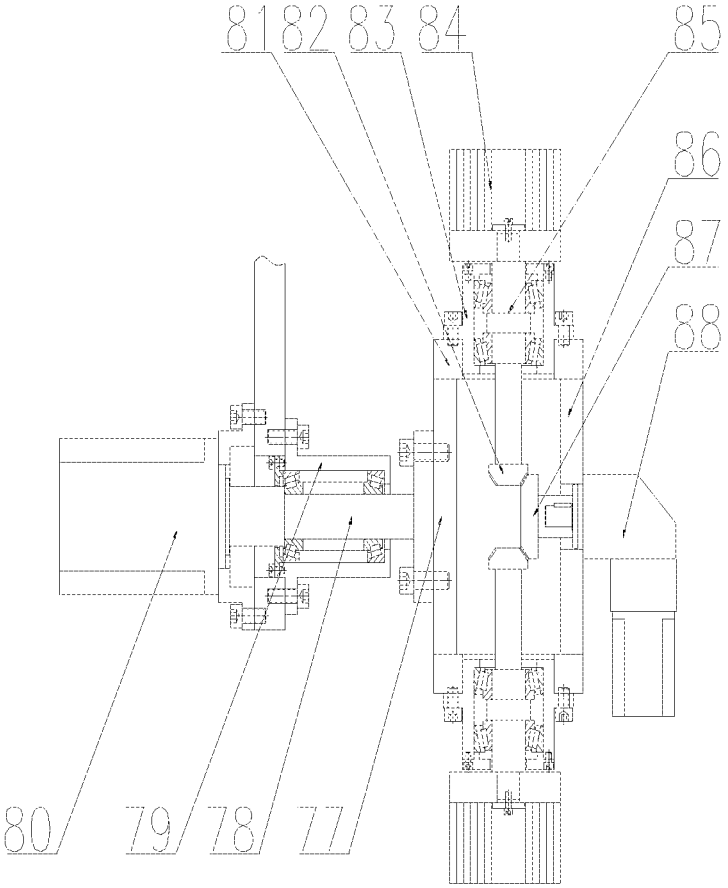
FIG. 5 is the main view of the upper deburring system of adjustable wheel deburring device.

The details and operation of the specific device according to the present invention will be described below with reference to the accompanying drawings.

The device comprises a frame 1, lower guiding posts 2, lower guiding sleeves 3, a lower fixing plate 4, a lower lifting plate 5, a lower guiding rail I 6, a lower sliding plate 7, a lower guiding rail II 8, a lower sliding block 9, a lower servo motor I 10, a lower fixing frame 11, a lower bearing pedestal I 12, a lower shaft I 13, a rotating frame 14, an upper cylinder I 15, an upper fixing plate 16, upper racks 17, an upper rail I 18, a left sliding plate 19, left bearing pedestals 20, left shafts 21, V-type rollers 22, an upper plate 23, an upper sliding plate 24, an upper guiding rail II 25, an upper lifting plate 26, upper guiding posts 27, upper guiding sleeves 28, upper cylinders II 29, an upper servo electric cylinder 30, an upper gear 31, right shafts 32, right bearing pedestals 33, a right sliding plate 34, an upper servo motor I 35, an overturning rod 36, a lower servo electric cylinder I 37, a lower servo electric cylinder II 38, a lower cylinder I 39, a tension pulley 40, a fixing block I 41, a lower servo electric cylinder III 42, a lower servo motor II 43, a lower servo motor III 44, a lower gear 45, an angle frame 46, lower racks 47, a lower guiding rail III 48, a left fixing frame 49, a sliding sleeve I 50, a connecting rod I 51, a supporting wheel I 52, a spring 53, brush bundles 54, a brush belt 55, a sliding sleeve II 56, a connecting rod II 57, a supporting wheel II 58, a sliding sleeve III 59, a connecting rod III 60, a supporting wheel III 61, a top plate 62, a lower vertical plate 63, a lower servo electric cylinder IV 64, a right adjusting wheel 65, a right bracket 66, a ring-pull 67, a lower bottom plate 68, a lower servo electric cylinder V 69, a left adjusting wheel 70, a rotating shaft I 71, a pulley I 72, a synchronous belt 73, a pulley II 74, a lower servo motor IV 75, a shaft II 76, a left plate 77, an upper shaft I 78, an upper bearing pedestal I 79, an upper servo motor I 80, an upper plate 81, a bevel gear I 82, an upper bearing pedestal II 83, round brushes 84, an upper shaft II 85, a right plate 86, a bevel gear II 87 and an upper servo motor II 88.

The lower lifting-translating-overturning system comprises: the four lower guiding sleeves 3 are fixed on the lower fixing plate 4; the four lower guiding posts 2 matching with the four lower guiding sleeves 3 are fixed below the lower lifting plate 5; the two lower cylinders I 39 are fixed below the lower fixing plate 4, and the output end thereof is hinged to the lower part of the lower lifting plate 5; the lower sliding plate 7 is mounted above the lower lifting plate 5 through the lower rail I 6; the lower servo electric cylinder II 38 is fixed on the right side above the lower lifting plate 5, and the output end thereof is connected with the lower sliding plate 7; the lower slider 9 is mounted above the lower sliding plate 7 through the lower rail II 8; the lower servo electric cylinder I 37 is fixed on the right side above the lower sliding plate 7, and the output end thereof is connected with the lower slider 9; the lower part of the lower fixing frame 11 is hinged to the lower slider 9; the upper end of the overturning rod 36 is hinged to the right side of the lower fixing frame 11; the lower end of the overturning rod 36 is hinged to the right side above the lower slider 7; the lower bearing pedestal I 12 is fixed above the top plate of the lower fixing frame 11; the lower shaft I 13 is mounted inside the lower bearing pedestal I 12 through a bearing; the lower servo motor I 10 is fixed below the top plate of the lower fixing frame 11, and the output end thereof is connected to the lower end of the lower shaft I 13; and the rotating frame 14 is fixed on the top end of the lower shaft I 13.

The clamping driving system comprises: the left sliding plate 19 and the right sliding plate 34 are respectively mounted above the upper fixing plate 16 through the upper rail I 18; the two left bearing pedestals 20 are fixed above the left sliding plate 19; the two left shafts 21 are respectively mounted inside the two left bearing pedestals 20 through bearings; the two right bearing pedestals 33 are fixed above the right sliding plate 34; the two right shafts 32 are respectively mounted inside the two right bearing pedestals 33 through bearings; the top ends of the two left shafts 21 and the two right shafts 32 are respectively fixed with V-type rollers 22; the upper cylinder I 15 is fixed above the upper fixing plate 16, and the output end thereof is connected with the left shaft 21; the upper gear 31 is fixed on the middle position above the upper fixing plate 16; the lower parts of the left sliding plate 19 and the right sliding plate 34 are respectively fixed with upper racks 17; the upper rack 17 is meshed with the upper gear 31; and the upper servo motor I 35 is fixed below the right sliding plate 34, and the output end thereof is connected with one of the right shafts 32.

The upper lifting-moving system comprises: the four upper guiding sleeves 28 are fixed above the top plate of the frame 1; the four upper guiding posts 27 matching with the four upper guiding sleeves 28 are fixed above the upper lifting plate 26; the two upper cylinders II 29 are also fixed on the top end of the frame 1, and the output ends thereof are hinged to the upper part of the upper lifting plate 26; the upper sliding plate 24 is mounted below the upper lifting plate 26 through the upper rail II 25; the upper vertical plate 23 is fixed below the upper sliding plate 24; and the upper servo electric cylinder 30 is fixed on the right side below the lower lifting plate 26, and the output end thereof is connected to the right side of the upper sliding plate 24.

The adjusting system comprises: the lower servo electric cylinder III 42 is fixed below the angle frame 46, and the output end thereof is fixed with the fixing block I 41; the tensioning wheel 40 is mounted below the fixing block I 41 through a pin shaft; the lower servo motor II 43 is fixed on the left side of the rotating frame 14, and the output end thereof is connected to the angle frame 46 through the rotating shaft II 76; the left fixing frame 49 and the right bracket 66 are respectively mounted on the top end of the angle frame 46 through the lower rail III 48; the left side of the left fixing frame 49 and the right side of the right bracket 66 are respectively fixed with lower racks 47; the lower servo motor III 44 is fixed below the top end of the angle frame 46, and the output end thereof is fixed with the lower gear 45; the lower gear 45 is meshed with the lower racks 47; the top plate 62 is fixed on the top of the angle frame 46; the vertical plate 63 is fixed below the top plate 62; the lower bottom plate 68 is fixed below the lower vertical plate 63; the sliding sleeve I 50, the sliding sleeve II 56 and the sliding sleeve III 59 are respectively hinged to the top plate 62, the sliding sleeve II 56 is placed in the middle position, and the sliding sleeve I 50 is placed on the left side of the sliding sleeve II 56; the connecting rod I 51 is slidably matched with the inner hole of the sliding sleeve I 50; the supporting wheel I 52 is mounted on the top end of the connecting rod I 51; the connecting rod II 57 is slidably engaged with the inner hole of the sliding sleeve II 56; the supporting wheel II 58 is mounted on top end of the connecting rod II 57; the connecting rod III 60 is slidably matched with the inner hole of the sliding sleeve III 59; the supporting wheel III 61 is mounted on the top end of the connecting rod III 60; the lower parts of the connecting rod I 51, the connecting rod II 57 and the connecting rod III 60 are hinged with the ring-pull 67; the cylinder body of the lower servo electric cylinder IV 64 is hinged with the lower vertical plate 63; the output end of the lower servo electric cylinder IV 64 is hinged with the ring-pull 67; the cylinder body of the lower servo electric cylinder V 69 is hinged with the lower bottom plate 68; the output end of the lower servo electric cylinder V 69 is hinged with the ring-pull 67; the right adjusting wheel 65 is mounted on the top end of the right bracket 66; the left adjusting wheel 70 is mounted on the top end of the left fixing frame 49 through the rotating shaft I 71; the pulley I 72 is fixed on the right side of the rotating shaft I 71; the lower servo motor IV 75 is fixed on the right side of the fixing frame 49, and the output end thereof is fixed with the pulley II 74; the pulley I 72 and the pulley II 74 are connected by the synchronous belt 73; the spring 53 is mounted below the brush bundles 54; the brush belt 55 is mounted with a plurality of brush bundle 54 which are closely arranged; and the inner side of the brush belt 55 is simultaneously meshed with the left adjusting wheel 70, the supporting wheel I 52, the supporting wheel II 58, the supporting wheel III 61, the right adjusting wheel 65, and the tension pulley 40.

The brush unit comprises: the upper bearing pedestal II 83 is fixed above the upper plate 81; the upper shaft II 85 is mounted inside the upper bearing pedestal II 83 through a bearing; the round brushes 84 are fixed above the upper shaft II 85; and the bevel gear I 82 is fixed below the upper shaft II 85. The present device comprises a plurality of sets of brush units uniformly distributed in the circumferential direction.

The upper deburring system comprises: the upper bearing pedestal I 79 is fixed on the right side of the upper plate 23; the upper shaft I 78 is mounted inside the upper bearing pedestal I 79 through a bearing; the right end of the upper shaft I 78 is connected with the left plate 77; the upper servo motor I 80 is fixed on the left side of the upper plate 23, and the output end thereof is connected to the left side of the upper shaft I 78; the upper plate 81 is fixed on the top end of the left plate 77; the right plate 86 is fixed below the upper plate 81 and placed on the right side of the left plate 77; the upper servo motor II 88 is fixed on the right side of the right plate 86, and the output end thereof is fixed with the bevel gear II 87; and the bevel gear II 87 is simultaneously meshed with the bevel gear I 82 of each brush unit.

During operation, the upper cylinder I 15 causes the four V-type rollers 22 to synchronously clamp the wheel through the upper rail I 18, the upper gear 31 and the upper racks 17; the upper servo motor I 35 rotates the clamped wheel through the right shaft 32; the lower servo motor IV 75 drives the left adjusting wheel 70 to rotate through the pulley I 72, the pulley II 74 and the synchronous belt 73; the left adjusting wheel 70 can drive the brush belt 55 to rotate; the lower servo motor III 44 can adjust the space between the left adjusting wheel 70 and the right adjusting wheel 65 through the lower gear 45, the lower racks 47 and the lower guiding rail III 48, to adapt to different sizes of wheels; at the same time, the lower servo electric cylinder III 42 moves the tensioning wheel 40 up and down to adapt to the belt length of the brush belt 55 after the adjustment of the space between the left adjusting wheel 70 and the right adjusting wheel 65; by the lower servo electric cylinder V 69 pulling the connecting rod I 51, the connecting rod II 57 and the connecting rod III 60 to move up and down, the height of the brush belt 55 between the left adjusting wheel 70 and the right adjusting wheel 65 can be adjusted; and by the lower servo electric cylinder IV 64 pulling the connecting rod I 51, the connecting rod II 57 and the connecting rod III 60 to move left and right, the shape of the brush belt 55 between the left adjusting wheel 70 and the right adjusting wheel 65 can be adjusted to adapt to various wheel back chambers of different shapes.

The lower servo motor II 43 can adjust the angle of the brush belt 55 in the vertical direction through the rotating shaft II 76; the lower servo motor I 10 can rotate the rotating frame 14 and the brush belt 55 in the vertical direction through the lower shaft I 13; the lower servo electric cylinder I 37 can adjust the angles of the rotating frame 14 and the brush belt 55 in horizontal direction through the lower rail II 8 and the overturning rod 36; the lower servo electric cylinder II 38 can adjust the position of the rotating frame 14 and the brush belt 55 in the horizontal direction through the lower rail I 6; and the lower cylinder I 39 can cause the rotating brush belt 55 to be lifted through the lower guiding posts 2 and the lower guiding sleeves 3, and the burrs therein can be removed when the brush belt 55 comes into contact with the wheel back cavity.

The upper servo motor II 88 drives the bevel gear II 87 to rotate, thereby driving each of the bevel gear I 82, the upper shaft II 85 and the round brushes 84 to simultaneously rotate through the meshing of the bevel gear II 87 and the bevel gear I 82; the upper servo motor I 80 can drive the left plate 77 and each of the round brushes 84 to rotate in the vertical direction through the upper shaft I 78; the upper servo electric cylinder 30 can adjust the position of the round brush 84 in the horizontal direction through the upper rail II 25 and the upper sliding plate 24; and the upper cylinder II 29 can lower the round brushes 84 through the upper guiding posts 27 and the upper guiding sleeves 28, and the front burrs are removed when the rotating round brushes 84 contact the front of the wheel.

What is claimed is:

1. Adjustable wheel deburring device comprises a frame, lower guiding posts, lower guiding sleeves, a lower fixing plate, a lower lifting plate, a lower guiding rail I, a lower sliding plate, a lower guiding rail II, a lower sliding block, a lower servo motor I, a lower fixing frame, a lower bearing pedestal I, a lower shaft I, a rotating frame, an upper cylinder I, an upper fixing plate, upper racks, an upper rail I, a left sliding plate, left bearing pedestals, left shafts, V-type rollers, an upper plate, an upper sliding plate, an upper guiding rail II, an upper lifting plate, upper guiding posts, upper guiding sleeves, upper cylinders II, an upper servo electric cylinder, an upper gear, right shafts, right bearing pedestals, a right sliding plate, an upper servo motor I, an overturning rod, a lower servo electric cylinder I, a lower servo electric cylinder II, a lower cylinder I, a tension pulley, a fixing block I, a lower servo electric cylinder III, a lower servo motor II, a lower servo motor III, a lower gear, an angle frame, lower racks, a lower guiding rail III, a left fixing frame, a sliding sleeve I, a connecting rod I, a supporting wheel I, a spring, brush bundles, a brush belt, a sliding sleeve II, a connecting rod II, a supporting wheel II, a sliding sleeve III, a connecting rod III, a supporting wheel III, a top plate, a lower vertical plate, a lower servo electric cylinder IV, a right adjusting wheel, a right bracket, a ring-pull, a lower bottom plate, a lower servo electric cylinder V, a left adjusting wheel, a rotating shaft I, a pulley I, a synchronous belt, a pulley II, a lower servo motor IV, a shaft II, a left plate, an upper shaft I, an upper bearing pedestal I, an upper servo motor I, an upper plate, a bevel gear I, an upper bearing pedestal II, round brushes, an upper shaft II, a right plate, a bevel gear II and an upper servo motor II, wherein the lower lifting-translating-overturning system comprises: the four lower guiding sleeves are fixed on the lower fixing plate; the four lower guiding posts matching with the four lower guiding sleeves are fixed below the lower lifting plate; the two lower cylinders I are fixed below the lower fixing plate, and the output end thereof is hinged to the lower part of the lower lifting plate; the lower sliding plate is mounted above the lower lifting plate through the lower rail I; the lower servo electric cylinder II is fixed on the right side above the lower lifting plate, and the output end thereof is connected with the lower sliding plate; the lower slider is mounted above the lower sliding plate through the lower rail II; the lower servo electric cylinder I is fixed on the right side above the lower sliding plate, and the output end thereof is connected with the lower slider; the lower part of the lower fixing frame is hinged to the lower slider; the upper end of the overturning rod is hinged to the right side of the lower fixing frame; the lower end of the overturning rod is hinged to the right side above the lower slider; the lower bearing pedestal I is fixed above the top plate of the lower fixing frame; the lower shaft I is mounted inside the lower bearing pedestal I through a bearing; the lower servo motor I is fixed below the top plate of the lower fixing frame, and the output end thereof is connected to the lower end of the lower shaft I; and the rotating frame is fixed on the top end of the lower shaft I;

the clamping driving system comprises: the left sliding plate and the right sliding plate are respectively mounted above the upper fixing plate through the upper rail I; the two left bearing pedestals are fixed above the left sliding plate; the two left shafts are respectively mounted inside the two left bearing pedestals through bearings; the two right bearing pedestals are fixed above the right sliding plate; the two right shafts are respectively mounted inside the two right bearing pedestals through bearings; the top ends of the two left shafts and the two right shafts are respectively fixed with V-type rollers; the upper cylinder I is fixed above the upper fixing plate, and the output end thereof is connected with the left shaft; the upper gear is fixed on the middle position above the upper fixing plate; the lower parts of the left sliding plate and the right sliding plate are respectively fixed with upper racks; the upper rack is meshed with the upper gear; and the upper servo motor I is fixed below the right sliding plate, and the output end thereof is connected with one of the right shafts;

the upper lifting-moving system comprises: the four upper guiding sleeves are fixed above the top plate of the frame; the four upper guiding posts matching with the four upper guiding sleeves are fixed above the upper lifting plate; the two upper cylinders II are also fixed on the top end of the frame, and the output ends thereof are hinged to the upper part of the upper lifting plate; the upper sliding plate is mounted below the upper lifting plate through the upper rail II; the upper vertical plate is fixed below the upper sliding plate; and the upper servo electric cylinder is fixed on the right side below the lower lifting plate, and the output end thereof is connected to the right side of the upper sliding plate;

the adjusting system comprises: the lower servo electric cylinder III is fixed below the angle frame, and the output end thereof is fixed with the fixing block I; the tensioning wheel is mounted below the fixing block I through a pin shaft; the lower servo motor II is fixed on the left side of the rotating frame, and the output end thereof is connected to the angle frame through the rotating shaft II; the left fixing frame and the right bracket are respectively mounted on the top end of the angle frame through the lower rail III; the left side of the left fixing frame and the right side of the right bracket are respectively fixed with lower racks; the lower servo motor III is fixed below the top end of the angle frame, and the output end thereof is fixed with the lower gear; the lower gear is meshed with the lower racks; the top plate is fixed on the top of the angle frame; the vertical plate is fixed below the top plate; the lower bottom plate is fixed below the lower vertical plate;

the sliding sleeve I, the sliding sleeve II and the sliding sleeve III are respectively hinged to the top plate, the sliding sleeve II is placed in the middle position, and the sliding sleeve I is placed on the left side of the sliding sleeve II; the connecting rod I is slidably matched with the inner hole of the sliding sleeve I; the supporting wheel I is mounted on the top end of the connecting rod I; the connecting rod II is slidably engaged with the inner hole of the sliding sleeve II; the supporting wheel II is mounted on top end of the connecting rod II; the connecting rod III is slidably matched with the inner hole of the sliding sleeve III; the supporting wheel III is mounted on the top end of the connecting rod III; the lower parts of the connecting rod I, the connecting rod II and the connecting rod III are hinged with the ring-pull; the cylinder body of the lower servo electric cylinder IV is hinged with the lower vertical plate; the output end of the lower servo electric cylinder IV is hinged with the ring-pull; the cylinder body of the lower servo electric cylinder V is hinged with the lower bottom plate; the output end of the lower servo electric cylinder V is hinged with the ring-pull; the right adjusting wheel is mounted on the top end of the right bracket; the left adjusting wheel is mounted on the top end of the left fixing frame through the rotating shaft I; the pulley I is fixed on the right side of the rotating shaft I; the lower servo motor IV is fixed on the right side of the fixing frame, and the output end thereof is fixed with the pulley II; the pulley I and the pulley II are connected by the synchronous belt; the spring is mounted below the brush bundles; the brush belt is mounted with a plurality of brush bundle which are closely arranged; and the inner side of the brush belt is simultaneously meshed with the left adjusting wheel, the supporting wheel I, the supporting wheel II, the supporting wheel III, the right adjusting wheel, and the tension pulley;

the brush unit comprises: the upper bearing pedestal II is fixed above the upper plate; the upper shaft II is mounted inside the upper bearing pedestal II through a bearing; the round brushes are fixed above the upper shaft II; and the bevel gear I is fixed below the upper shaft II; the present device comprises a plurality of sets of brush units uniformly distributed in the circumferential direction;

the upper deburring system comprises: the upper bearing pedestal I is fixed on the right side of the upper plate; the upper shaft I is mounted inside the upper bearing pedestal I through a bearing; the right end of the upper shaft I is connected with the left plate; the upper servo motor I is fixed on the left side of the upper plate, and the output end thereof is connected to the left side of the upper shaft I; the upper plate is fixed on the top end of the left plate; the right plate is fixed below the upper plate and placed on the right side of the left plate; the upper servo motor II is fixed on the right side of the right plate, and the output end thereof is fixed with the bevel gear II; and the bevel gear II is simultaneously meshed with the bevel gear I of each brush unit.

* * * * *